US006675726B1

(12) United States Patent
van Kessel et al.

(10) Patent No.: US 6,675,726 B1
(45) Date of Patent: Jan. 13, 2004

(54) SYSTEM FOR DETERMINING PROCESS PARAMETERS RELATING TO THERMAL PROCESSES SUCH AS, FOR INSTANCE, WASTE INCINERATION

(75) Inventors: Lambertus Bernardus Maria van Kessel, Apeldoorn (NL); Gerrit Brem, Wapenveld (NL)

(73) Assignee: Nederlandse Organisatie voor toegepast-natuurwetenchappelijk Onderzoek TNO, Delft (NL)

( * ) Notice: Subject to any disclaimer, the term of this patent is extended or adjusted under 35 U.S.C. 154(b) by 0 days.

(21) Appl. No.: 09/980,894

(22) PCT Filed: May 6, 2000

(86) PCT No.: PCT/NL00/00377

§ 371 (c)(1),
(2), (4) Date: Jul. 2, 2002

(87) PCT Pub. No.: WO00/75569

PCT Pub. Date: Dec. 14, 2000

(30) Foreign Application Priority Data

Jun. 4, 1999 (NL) ..... 1012239
Feb. 28, 2000 (NL) ..... 1014516

(51) Int. Cl.[7] ..... F23N 5/00; F23G 5/50

(52) U.S. Cl. ..... 110/185; 110/346

(58) Field of Search ..... 110/214, 238, 110/234, 346, 342, 185, 186

(56) References Cited

U.S. PATENT DOCUMENTS 4,101,632 A * 7/1978 Lamberti ..... 423/210
4,758,519 A * 7/1988 Nakao et al. ..... 436/81
4,895,082 A * 1/1990 Mindermann et al. ..... 110/186
4,984,524 A * 1/1991 Mindermann et al. ..... 110/346
5,280,756 A * 1/1994 Labbe ..... 110/191
5,915,310 A * 6/1999 Hura et al. ..... 110/345
6,182,584 B1 * 2/2001 Gaudio ..... 110/229

* cited by examiner

*Primary Examiner*—Kenneth B. Rinehart
(74) *Attorney, Agent, or Firm*—Hoffmann & Baron, LLP

(57) ABSTRACT

The invention relates to a system for thermal combustion processes of matter such as, for instance, waste incineration. The system comprises a computer for measuring parameters of the combustion of the matter, wherein use, matter, such as for instance waste, is supplied to the system and combusted, thereby forming a flue gas. The system further comprises means for determining the concentration of $CO_2$, $O_2$ and $H_2O$ in the flue gas. The computer is arranged for determining, on the basis of the measured concentrations, the rate of combustion and/or the composition of the combustible part $CH_yO_z$ of the waste supplied to the system, for the purpose of process control.

12 Claims, 2 Drawing Sheets

SYSTEM FOR DETERMINING PROCESS PARAMETERS RELATING TO THERMAL PROCESSES SUCH AS, FOR INSTANCE, WASTE INCINERATION

This application is the U.S. National Phase of International Application Number PCT/NL00/00377 filed on Jun. 5, 2000, which is incorporated herein by reference.

BACKGROUND OF THE INVENTION

This invention relates to a system for determining process parameters relating to thermal combustion processes of matter such as, for instance, waste in an incinerator, comprising sensor means and a computer coupled thereto for determining the parameters, wherein, in use, matter having a combustible part $CH_YO_z$ is supplied to the incinerator and combusted, thereby forming a flue gas.

This invention relates to a system for determining process parameters relating to thermal combustion processes of matter such as, for instance, waste in an incinerator, comprising sensor means and a computer coupled thereto for determining the parameters, wherein, in use, matter having a combustible part $CH_yO_z$ is supplied to the incinerator and combusted, thereby forming a flue gas.

Operational management of the existing plants for waste incineration is rendered more difficult by the varying composition of the waste that is supplied to an incinerator of the plant. Due to the circumstance that changes in the properties of the waste are not recognized timely in the process behavior, the existing control systems are not properly able to regulate the process.

If, however, the waste composition of the waste in the incinerator could be derived on-line, this would enable better adjustment to variations in the waste composition, thereby rendering the waste incineration process better controllable. Such a derivation, however, is highly complicated.

SUMMARY OF THE INVENTION

The object of the invention is to provide a system that can be utilized in a plant for combustion of matter to meet the drawbacks outlined. Accordingly, the system for determining process parameters relating to the thermal combustion of matter is characterized in that the sensor means are arranged for measuring the fractions $X_{CO2}$, $X_{O2}$ and $XH_{2O}$ in the flue gas and that the computer is arranged for determining, on the basis of the measured fractions, the composition (y/z) and/or the heat of combustion ($H_{CHyOz}$, [J/kg]) of the combustible part $CH_yO_z$, with $X_{O2}$, $X_{H2O}$, $X_{CO2}$ respectively representing the fractions of $O_2$, $H_2O$ and $CO_2$ in the flue gas.

The object of the invention is to provide a system that can be utilized in a plant for combustion of matter to meet the drawbacks outlined. Accordingly, the system for determining process parameters relating to the thermal combustion of matter is characterized in that the sensor means are arranged for measuring the fractions $X_{CO2}$, $X_{O2}$ and $X_{H2O}$ in the flue gas and that the computer is arranged for determining, on the basis of the measured fractions, the composition (y/z) and/or the heat of combustion ($H_{CHyOz}$, [J/kg]) of the combustible part $CH_yO_z$, with $X_{O2}$, $X_{H2O}$, $X_{CO2}$ respectively representing the fractions of $O_2$, $H_2O$ and $CO_2$ in the flue gas.

By measuring, in accordance with the invention, just the fractions $X_{CO2}$, $X_{O2}$ and $X_{H2O}$ in the flue gas, relevant parameters (the heat of combustion and/or the composition of the combustible part) for possible regulation of the matter combustion can be determined. More particularly, it holds that, in use, the computer calculates the value of Z on the basis of the formulae:

$$z = 2 \cdot X_C + \frac{1}{2} \cdot y - \frac{2 \cdot X_C \cdot X_{N2} \cdot X_{02,air}}{X_{CO2} \cdot X_{N2,air}} + \frac{2 \cdot X_C \cdot X_{O2}}{X_{CO2}};$$

and $$X_{N2} = 1 - X_{O2} - X_{H2O} - X_{CO2}$$

wherein $X_{O2,air}$ (the oxygen fraction in air supplied to the incinerator), $X_{N2,air}$ (the nitrogen fraction in air supplied to the incinerator), $X_c$ (the uncombusted fraction of carbon) and y are predetermined values. Preferably, it will then hold that the predetermined value of $X_c$ is inbetween 0.9 and 1. Further, it holds in particular that, in use, the computer calculates the value of $H_{CHyOz}$ on the basis of the formulae $$H_{CHyOz} = \frac{408.4 + 102.4 \cdot y - 156.8 \cdot z}{M_{CHyOz}} \cdot 10^3;$$

and $$M_{CHyOz} = 0.012 + 0.001y + 0.016z.$$

According to a further advanced embodiment of the system, it holds that the system further comprises sensor means for determining the air flow $\Phi_{tot}$ of the air which, in use, is supplied to the incinerator, the computer being arranged to determine on the basis of the measured fractions $X_{CO2}$, $X_{O2}$ and $X_{H2O}$, the ash-free heating value ($H_{waste,ash-free}$, [J/kg ash-free]) and/or, further on the basis of the measured air flow $\Phi_{tot}$, the amount of heat ($Q_{heat}$, [W]) which is released upon the combustion. More particularly, it holds further that the computer is further arranged for further determining, on the basis of the predetermined value of the inert fraction of the waste ($X_{inert}$, [kg inert/kg waste]), the following four parameters: the waste flow ($\Phi_{waste}$, [kg/s]), the moisture fraction of the waste ($X_{H2O,waste}$, [kg water/kg waste]), the heating value of the total waste ($H_{waste}$, [J/kg waste]) and/or the fraction of uncombusted ($X_{uncombusted}$, [kg uncombusted/kg ash]).

On the basis of one or more of the above-mentioned parameters as determined by the computer, the waste incineration plant can be controlled in a manner known per se, such that combustion is optimal.

BRIEF DESCRIPTION OF THE DRAWINGS

The invention will presently be further elucidated with reference to the drawings. In the drawings.

DETAILED DESCRIPTION OF THE PREFERRED EMBODIMENTS

Figure 1:
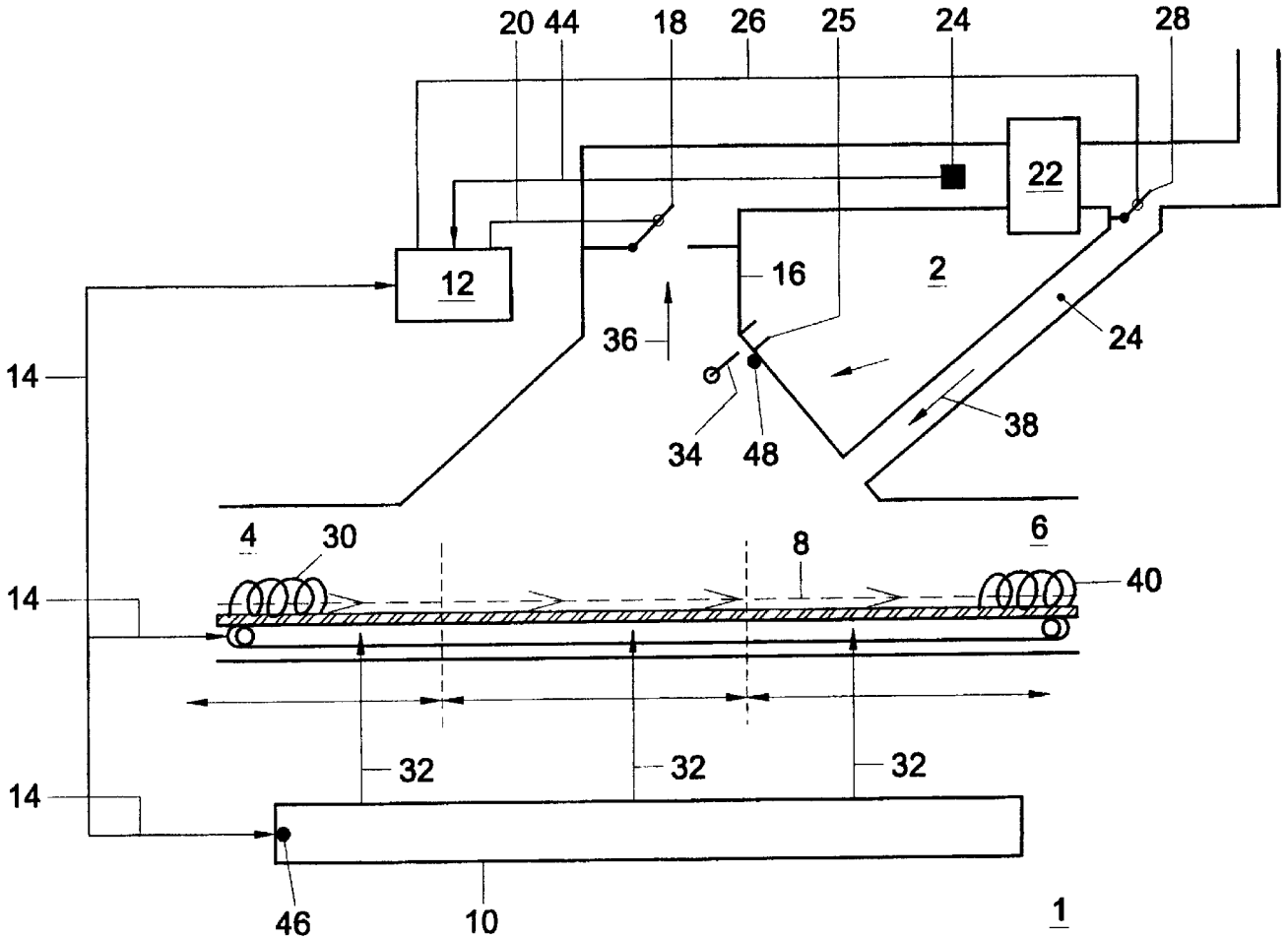
FIG. 1 shows a possible embodiment of a plant for waste incineration comprising a system according to the invention.

In FIG. 1, a plant for waste incineration is designed by reference numeral 1. The plant comprises an incinerator 2, known per se, comprising an entrance 4 to which the waste is supplied. The incinerator 2 further comprises an exit 6 for discharge of the combustion products formed upon combustion. The plant further comprises a conveying device 8 which conveys the waste for combustion from the entrance 4 to the exit 6. The plant in this example further comprises means 10, known per se, for controlling the amount of air and/or optionally the temperature of the air which is supplied to the incinerator. The plant further comprises a control unit 12, which in this example comprises a computer for controlling various settings of the incinerator. Thus the computer 12 can, for instance, control the air supply means 10 and/or the speed of the conveying device 8. These controls can, in this example, be carried out via line 14.

The incinerator may further comprise a chimney 16 with a controllable outlet 18. The outlet 18 in this example is likewise controlled by the computer 12, via a line 20. In the chimney, further, a dust catcher 22 known per se is included. Via a conduit 24 at least a portion of the flue gases which leave the incinerator via the chimney 16 and which have been stripped of dust by means of the device 22 can be fed back to the incinerator. This involves so-called flue gas recirculation. Further, adjacent the chimney 16 an inlet 25 may be arranged via which inlet secondary air can be supplied to the incinerator. The computer 12 may further be arranged to control a control valve 28, arranged in the return conduit 24, via a line 26.

Figure 2:
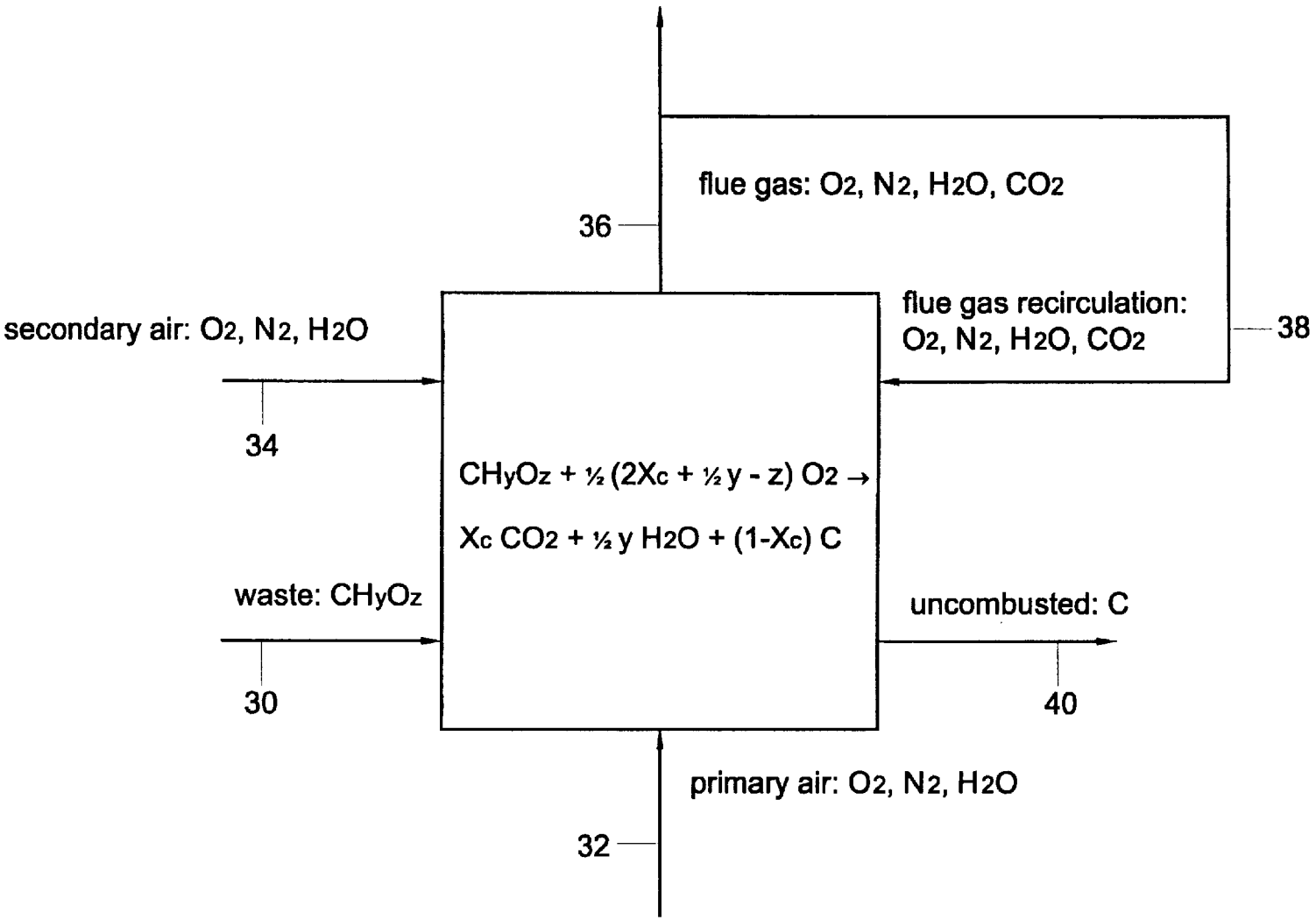
FIG. 2 shows a simplified representation of the waste incineration process of the system according to FIG. 1.

In FIG. 2 the combustion process of the plant according to FIG. 1 is schematically indicated. The incinerator proper is represented here by a square. The waste that is supplied to the incinerator via the entrance is designated by reference numeral 30. The primary air that is supplied to the incinerator via the air supply means 10 is designated by reference numeral 32. The secondary air that is supplied via inlet 25 to the incinerator is designated by reference numeral 34. The flue gas that leaves the incinerator via the chimney 16 is designated by reference numeral 36, whilst the portion of the flue gas that is recirculated to the incinerator via the conduit 24 is designated by reference numeral 38. The portion of the waste that is not burnt in the incinerator is designated by reference numeral 40. Output streams therefore consist of the flue gas and the uncombusted waste. The waste consists of a fraction of combustible ($CH_yO_z$), moisture and inert. The values of y and z are to be further determined. In the primary and secondary air, also the water present in the air is included. The composition of the flue gas recirculation is equal to the composition of the flue gas. It has been assumed that the uncombusted waste consists solely of carbon. The combustible part of the waste reacts with oxygen to form carbon dioxide, water and carbon. Here, a carbon conversion ($X_c$, [mol/mol]) is assumed.

The fraction of moisture in the primary and secondary air can be calculated if the temperature and the relative humidity of the air are known. The saturated vapor pressure of water ($P^0_{H2O}$, [Pa]) can be calculated using the temperature of the ($T_{air}$, [K]).

$$P^0_{H2O} = 133.32 \exp\left(18.3036 - \cdot \frac{3816.44}{T_{air,} - 46.13}\right) \tag{1}$$

The fraction of moisture in the air ($X_{H2O,air}$, [mol/mol]) can now be calculated using the relative humidity ($RH_{air}$, [%]) and the total pressure (P, [Pa]).

$$X_{H2O,air} = \frac{P^o_{H2O}, \frac{RHair}{100}}{P} \tag{2}$$

The fraction of oxygen and nitrogen in the air can now be calculated as follows.

$$X_{O2,air}=0.2095(1-X_{H2O,air}) \tag{3}$$

$$X_{N2,air}=0.7905(1-X_{H2O,air}) \tag{4}$$

If the other gases present in the flue gas are disregarded, the fraction of nitrogen in the flue gas ($X_{N2}$, [mol/mol]) can be calculated from the fraction of oxygen, water and carbon dioxide ($X_{O2}$, $X_{H2O}$, $X_{CO2}$, [mol/mol]):

$$X_{N2}=1-X_{O2}-X_{H2O}-X_{CO2} \tag{5}$$

For calculating the waste composition using the mass balances, presently the following data are needed. First, the molar flow rates of the primary and secondary air and of the flue gas recirculation ($\Phi_{primary}$, $\Phi_{secondary}$, $\Phi_{recirculation}$, [mol/s]). Next, it was chosen to fix the carbon conversion and a value for y. Realistic values for these constants will be discussed later on.

The flue gas flow ($\Phi_{flue\ gas}$, [mol/s]) can be calculated using a mole balance over the nitrogen.

$$X_{N2,air}(\Phi_{primary}+\Phi_{secondary})+X_{N2}\Phi_{recirculation}=X_{N2}\Phi_{flue\ gas} \tag{6}$$

Describing this equation gives:

$$\Phi_{fluegas} = \frac{X_{N2,air}}{X_{N2}}, (\Phi_{primary} + \Phi_{secondary}) + \Phi_{recirculation} \tag{7}$$

The molar flow of combustible ($\Phi_{CHyOz}$, [mols]) can be calculated using a mole balance over carbon:

$$\Phi_{CHyOz}+X_{CO2}\Phi_{recirculation}=X_{CO2}\Phi_{flue\ gas}+(1-X_c).\Phi_{CHyOz} \tag{8}$$

Combination of the carbon balance and nitrogen balance yields $$\Phi_{CHyOz} = \frac{X_{CO2} \cdot X_{N2,air}}{X_C \cdot X_{N2}} (\Phi_{primary} + \Phi_{secondary}) \tag{9}$$

z can be calculated using the mole balance over oxygen.

$$X_{O2,air} \cdot (\Phi_{primary} + \Phi_{secondary}) + X_{O2} \cdot \Phi_{recirculation} \cdot = X_{O2} \cdot \Phi_{fluegas} + \frac{1}{2} \cdot \left(2 \cdot X_C + \frac{1}{2} y - z\right) \cdot \Phi_{CHyOz} \tag{10}$$

Combination of the carbon balance, nitrogen balance and oxygen balance yields $$z = 2 \cdot X_C + \frac{1}{2} \cdot y - \frac{2 \cdot X_C \cdot X_{N2} \cdot X_{02,air}}{X_{CO2} \cdot X_{N2,air}} + \frac{2 \cdot X_C \cdot X_{O2}}{X_{CO2}} \tag{11}$$

From this equation it follows that z is not dependent on the primary and secondary air flow rates ($\Phi_{primary}$, $\Phi_{secondary}$, and $\Phi_{tot}$) and the flue gas circulation flow rates. For the calculation of z, only the flue gas composition needs to be measured. A logical consequence of this is that for instance leakage airs do not have any influence on the calculation of z either. In fact, additional air translates into a change of the flue gas composition, such that z remains equal.

The molar flow of water in the waste ($\Phi_{H2O}$, [mol/s] can be calculated using the mole balance over water:

$$\Phi H_{2O}+X_{H2O,air}.(\Phi_{primary}+\Phi_{secondary})+X_{H2O}.\Phi_{recirculation}+\tfrac{1}{2}.y, \Phi_{CHyOz}=X_{H2O}.\Phi_{fluegas} \tag{12}$$

Description of this equation gives:

$$\Phi_{H2O} = \left(\frac{X_{H2O} \cdot X_{N2,air}}{X_{N2}} - X_{H2O,air} - \frac{1}{2} \cdot y \cdot \frac{X_{CO2} \cdot X_{N2,air}}{X_C \cdot X_{N2}}\right) \cdot (\Phi_{primary} + \Phi_{secondary}) \quad (13)$$

The mole mass of the combustible part of the waste ($M_{CHyOz}$, [kg/mol]) is equal to $$M_{CHyOz}=0.012+0.001y+0.016z \quad (14)$$

The heat of combustion of the combustible part of the waste ($H_{CHyOz}$, [J/kg]) can be calculated using Michel's equation:

$$H_{CHyOz} = \frac{408.4 + 102.4 \cdot y - 156.8 \cdot z}{M_{CHyOz}} \cdot 10^3 \quad (15)$$

Formula 15 too is independent of the flow rates mentioned.

Next, it is chosen to characterize the combustion process on the basis of the ash-free waste composition. The inert part of the waste will therefore initially not be included in the calculations. There are two reasons for this. First, inclusion of the inert part introduces an additional uncertainty into the calculation because the exact value of the inert fraction is not known. Second, only the heat capacity of the inert part has any influence on the energy balance of the incinerator. This heat capacity, however, is small with respect to the total energy content of the incinerator.

The moisture fraction based on the ash-free waste ($X_{H2O,ash\text{-}free}$, [kg water/kg ash-free] can now be calculated as follows:

$$X_{H2O,ashfree} = \frac{\Phi_{H2O} \cdot M_{H2O}}{\Phi_{H2O} \cdot M_{H2O} + \Phi_{CHyOz} \cdot M_{CHyOz}} \quad (16)$$

Elaboration of this equation yields:

$$X_{H2O,ashfree} = \frac{M_{H2O}}{M_{H2O} + \frac{1}{\left(\frac{X_{H2O} \cdot X_C}{X_{CO2}} - \frac{X_{H2O,air} \cdot X_c \cdot X_{N2}}{X_{CO2} \cdot X_{N2,air}} - \frac{1}{2} \cdot y\right)} M_{CHyOz}} \quad (17)$$

From this equation, it follows that the moisture fraction is also independent of the flow rates.

The ash-free heating value ($H_{waste,ash\text{-}free}$, [J/kg ash-free]) is now equal to:

$$H_{waste,ash\text{-}free}=(1-X_{H2O,ash\text{-}free}).H_{CHyOz}-X_{H2O,ash\text{-}free}.H_{evap} \quad (18)$$

$H_{evap}$ is the evaporative value of water and is equal to 2,444, $10^6$ J/kg. The ash-free heating value can therefore be calculated if the flue gas composition is measured and if a particular value is chosen for y and $X_c$. Also needed are the constant values determined on the basis of the formulae 1 to 4. The amount of heat ($Q_{heat}$, [W]) which is released upon the combustion is equal to:

$$Q_{heat} = H_{waste,ashfree} \cdot \frac{\Phi_{CHyOz} \cdot M_{CHyOz}}{1 - X_{H2O,ashfree}} \quad (19)$$

If the inert fraction of the waste ($X_{inert}$, [kg inert/kg waste]) is known, the following four calculations can be carried out. First, the waste flow ($\Phi_{waste}$, [kg/s]) can be calculated using the following formula:

$$\Phi_{waste} = \frac{\Phi_{CHyOz} \cdot M_{CHyOz} + \Phi_{H2O} \cdot M_{H2O}}{1 - X_{inert}} \quad (20)$$

The moisture fraction of the waste ($X_{H2O}$, [kg water/kg waste]) can now be calculated as follows:

$$X_{H2O} = \frac{\Phi_{H2O} \cdot M_{H2O}}{\Phi_{waste}} \quad (21)$$

The heating value of the total waste ($H_{waste}$, [J/kg waste]) is now equal to:

$$H_{waste}=(1-X_{inert}-X_{H2O,waste}).H_{CHyOz,}-X_{H20,waste}.H_{evap} \quad (22)$$

For this heating value, in principle the same holds true as for the ash-free heating value. The heating value of the total waste is independent of the value of the flow rates.

The fraction of uncombusted ($X_{uncombusted}$, [kg C/kg ash]) can be calculated using the following relation:

$$X_{uncombusted} = \frac{(1 - X_C) \cdot 0.012}{\frac{M_{CHy}Oz \cdot X_{inert}}{1 - X_{inert} - X_{H2O,waste}} + (1 - X_C) \cdot 0.012} \quad (23)$$

Since it has been chosen to fix the y value, an analysis of the waste composition was carried out. On the basis of the standard composition of waste as used in the FACE model, an estimate of the variation in y and z was made. In Table 1 the composition of different components of combustible is represented.

TABLE 1

Standard composition of the FACE model

| Component | C | H | O | Water | Inert |
|---|---|---|---|---|---|
| Paper | 0.3313 | 0.0473 | 0.3026 | 0.2364 | 0.0824 |
| Plastic | 0.6917 | 0.1039 | 0.0209 | 0.1000 | 0.0835 |
| GFT | 0.1860 | 0.0251 | 0.1394 | 0.5114 | 0.1381 |
| Inert | 0.0000 | 0.0000 | 0.0000 | 0.0000 | 1.0000 |

On the basis of the data from Table 1, the values of y and z for the different components can be calculated. These values are represented in Table 2.

TABLE 2 y and z values of CHyOz for combustible components

| Component | y | z |
|---|---|---|
| Paper | 1.713 | 0.685 |
| Plastic | 1.803 | 0.023 |
| GFT | 1.619 | 0.562 |

The value of y therefore varies at a maximum between 1.6 and 1.8 and the value of z between 0.0 and 0.7. On the basis of the waste composition of the waste in random waste incineration plants, an estimate was made of the average waste composition. In Table 3, three different waste compositions are represented in which the plastic and GFT (Vegetables/Fruit/Garden Refuse) fraction are strongly varied.

TABLE 3

| Waste composition | | | |
|---|---|---|---|
| Component | | | |
| Paper | 0.34 | 0.34 | 0.34 |
| Plastic | 0.11 | 0.25 | 0.05 |
| GFT | 0.37 | 0.23 | 0.43 |
| Inert | 0.18 | 0.18 | 0.18 |
| Total waste | | | |
| y | 1.71 | 1.75 | 1.69 |
| z | 0.46 | 0.32 | 0.54 |
| Inert | 0.27 | 0.26 | 0.27 |
| Water | 0.28 | 0.22 | 0.31 |

Accordingly, the value of y is fairly constant for different waste compositions. A good estimate of y is 1.72.

Another fixed variable is the carbon conversion. The value of $X_c$ is directly coupled to the percentage of uncombusted. In practice, this value varies between 0 and 5%, which corresponds to a value of 1 to 0.95 for $X_c$. A good estimate of $X_c$ is 0.98.

The plant according to FIG. 1 further comprises sensor means for measuring the concentrations of $CO_2$, $O_2$, and $H_2O$ in the flue gas. Further, the sensor means 42 are suitable for measuring the concentration of the flue gas. Thus, on the basis of the concentration of $CO_2$ and the concentration of the flue gas, the fraction $X_{CO2}$ is known. The fraction $X_{CO2}$ indicates the number of moles of $CO_2$ per mol of flue gas. Entirely by analogy, therefore, the fractions $X_{O2}$ and $X_{H2O}$ in the flue gas are known. The information obtained by means of the sensor means is supplied via line 44 to the computer 12.

The computer 12 is arranged for determining, on the basis of the fractions $X_{CO2}$, $X_{O2}$ and $X_{H2O}$ in the flue gas, the composition (y/z) and/or the heating value ($H_{CHyOz}$, [J/kg]) of the combustible part $CH_yO_z$ of the matter supplied to the system. In use, the computer calculates the value of z on the basis of the formulae:

$$z = 2 \cdot X_C + \frac{1}{2} \cdot y - \frac{2 \cdot X_C \cdot X_{N2} \cdot X_{02,air}}{X_{CO2} \cdot X_{N2,air}} + \frac{2 \cdot X_C \cdot X_{O2}}{X_{CO2}} \tag{11}$$

and $$X_{N2}=1-X_{O2}-X_{H2O}-X_{CO2} \tag{5}$$

The predetermined constant values $X_{O2,air}$ and $X_{N2,air}$ can be determined beforehand on the basis of the formulae 1 to 4 and be inputted into the computer.

Also, an estimate of the value of y can be inputted into the computer beforehand. As noted, a good estimate is y=1.72. An estimate of the carbon conversion $X_c$ can also have been inputted into the computer beforehand. As noted, a good estimate is $X_c$=0.98.

In use, the computer calculates the value of $H_{CHyOz}$.

$$H_{CHyOz} = \frac{408.4 + 102.4 \cdot y - 156.8 \cdot z}{M_{CHyOz}} \cdot 10^3 \tag{15}$$

and $$M_{CHyOz}=0.012+0.001y+0.016z \tag{14}$$

The system further comprises sensor means 46 and 48, schematically indicated in FIG. 1, for respectively determining the flow rate $\Phi_{primary}$ of the primary amount of air which is supplied to the incinerator by means of the air supply means 10, as well as the flow rate $\Phi_{secondary}$ of the secondary amount of air which is supplied to the incinerator via the inlet 25. The sensor means 46 and 48 are likewise connected to the computer 12 for transmitting the flow rates to the computer. The computer 12 is arranged for determining the total flow rate of the air supplied to the incinerator, with $\Phi_{tot}=\Phi_{primary}+\Phi_{secondary}$. The computer is further arranged for determining on the basis of the measured fractions $X_{CO2}$, $X_{O2}$ and $X_{H2O}$ as well as the measured air flow $\Phi_{tot}$, the ash-free heating value $H_{waste,ash\text{-}free}$, [J/kg ash-free]) and/or the amount of heat ($Q_{heat}$, [W]) which is released upon the combustion.

More particularly, in use, the computer determines the ash-free heating value $H_{waste,ash\text{-}free}$ on the basis of the formula:

$$X_{H2O,ashfree} = \frac{M_{H2O}}{M_{H2O} + \frac{1}{\left(\frac{X_{H2O} \cdot X_C}{X_{CO2}} - \frac{X_{H2O,air} \cdot X_c \cdot X_{N2}}{X_{CO2} \cdot X_{N2,air}} - \frac{1}{2} \cdot y\right)} M_{CHyOz}} \tag{17}$$

wherein $M_{H2O}$ represents the molar mass of water and $H_{evap}$ the evaporative heat of water. It is noted that for calculating the other heating values the value of $\Phi_{tot}$ is not relevant. The constant values for $M_{H2O}$ and $H_{evap}$ have been priorily inputted into the computer. Further, the computer determines, in use, the amount $Q_{heat}$ which is released upon the combustion, on the basis of the formulae:

$$Q_{heat} = H_{waste,ashfree} \cdot \frac{\Phi_{CHyOz} \cdot M_{CHyOz}}{1 - X_{H2O,ashfree}}; \text{ and} \tag{19}$$

$$\Phi_{CHyOz} = \frac{X_{CO2} \cdot X_{N2,air}}{X_C \cdot X_{N2}} (\Phi_{primary} + \Phi_{secondary}) \tag{9}$$

For carrying out this calculation, the measured value of $\Phi_{tot}$ therefore is relevant.

The computer is further arranged to determine, on the basis of the predetermined value of the inert fraction of the waste ($X_{inert}$, [kg inert/kg waste]), the following four parameters on the basis of the formulae 20 to 23, respectively: the waste flow $\Phi_{waste}$, [kg/s]), the moisture fraction of the waste ($X_{H2O,waste}$, [kg water/kg waste]), the heating value of the total waste ($H_{waste}$, [J/kg waste]) and/or the fraction of uncombusted ($X_{unombusted}$, [kg C/kg ash]). The computer therefore determines, in use, $\Phi_{waste}$ on the basis of the following formula:

$$\Phi_{waste} = \frac{\Phi_{CHyOz} \cdot M_{CHyOz} + \Phi_{H2O} \cdot M_{H2O}}{1 - X_{inert}}$$

In use, the computer calculates the value of $X_{H2O}$ on the basis of the following formula:

$$X_{H2O} = \frac{\Phi_{H2O} \cdot M_{H2O}}{\Phi_{waste}}$$

Further, it holds that, in use, the computer calculates $H_{waste}$ on the basis of the following formula:

$$H_{waste}=(1-X_{inert}-X_{H2O}).H_{CHyOz}-X_{H2O}.H_{evap}.$$

Also, it holds that, in use, the computer determines $X_{uncombusted}$ on the basis of the following formula:

$$X_{uncombusted} = \frac{(1 - X_C)\cdot 0.012}{\frac{M_{CHyOz}\cdot X_{inert}}{1 - X_{inert} - X_{H2O,waste}} + (1 - X_C)\cdot 0.012} \quad (23)$$

In the system, the computer can control the waste incineration process on the basis of one or more of the parameters calculated. Thus, for instance, on the basis of the determined amount of heat released upon the combustion ($Q_{heat}$), the ash-free heating value $H_{waste,ash\text{-}free}$) and/or the heating value of the total waste ($H_{waste}$), it is possible to control the amount of air and/or the temperature of the air which is supplied to the incinerator 2 by means of the air supply means 10, 25. Also, on the basis of other parameters which have been calculated using the computer 2, these and/or other settings of the incinerator can be controlled, such as the speed of the conveying means 8, a metering slide of the entrance 4, the setting of the valves 18, 28, and so forth. Such variants are each understood to fall within the scope of the invention.

What is claimed is:

1. A system for determining process parameters relating to thermal combustion processes of matter such as, for instance, waste in an incinerator, comprising sensor means and a computer coupled thereto for determining the parameters, wherein, in use, matter having a combustible part $CH_yO_z$ is supplied to the incinerator and combusted, thereby forming a flue gas, characterized in that the sensor means are arranged for measuring the fractions $X_{CO2}$, $X_{O2}$ and $X_{H2O}$ in the flue gas and that the computer is arranged for determining, on the basis of the measured fractions, the composition (y/z) and/or the heat of combustion ($H_{CHyOz}$, [J/kg]) of the combustible part $CH_yO_z$, with $X_{O2}$, $X_{H2O}$, $X_{CO2}$ respectively representing the fractions of $O_2$, $H_2O$ and $CO_2$ in the flue gas.

2. A system according to claim 1, characterized in that, in use, the computer calculates the value of Z on the basis of the formulae:

$$z = 2\cdot Xc + \frac{1}{2}\cdot y - \frac{2\cdot X_C\cdot X_{N2}\cdot X_{02,air}}{X_{CO2}\cdot X_{N2,air}} + \frac{2\cdot X_C\cdot X_{O2}}{X_{CO2}} \quad (11)$$

and $$X_{N2}=1-X_{O2}-X_{H2O}-X_{CO2} \quad (5)$$

wherein $X_{O2,air}$ (the oxygen fraction in air supplied to the incinerator), $X_{N2,air}$ (the nitrogen fraction in air supplied to the incinerator), $X_c$ (the uncombusted fraction of carbon) and y are predetermined constant values.

3. A system according to claim 2, characterized in that the predetermined value $X_c$ is between 0.90 and 1.

4. A system according to claim 2, characterized in that, in use, the computer calculates the value of $H_{CHyOz}$ on the basis of the formulae:

$$H_{CHyOz} = \frac{408.4 + 102.4\cdot y - 156.8\cdot z}{M_{CHyOz}}\cdot 10^3 \quad (15)$$

and $$M_{CHyOz}=0.012+0.001y+0.016z \quad (14)$$

5. A system according to claim 4, characterized in that, in use, the computer determines the ash-free heating value $H_{waste,ash\text{-}free}$ on the basis of the formulae:

$$H_{waste,ash\text{-}free}=(1-X_{H2O,ash\text{-}free}).H_{CHyOz}-X_{H2O,ash\text{-}free}.H_{evap} \quad (18)$$

and $$X_{H2O,ashfree} = \frac{M_{H2O}}{M_{H2O} + \frac{1}{\left(\frac{X_{H2O}\cdot X_c}{X_{Co2}} - \frac{X_{H2O,air}\cdot X_c\cdot X_{N2}}{X_{CO2}\cdot X_{N2,air}} - \frac{1}{2}\cdot y\right)} M_{CHyOz}} \quad (17)$$

wherein $M_{H2O}$ represents the known molar mass of water and $H_{evap}$ represents the known evaporative heat of water.

6. A system according to claim 1, characterized in that the system further comprises sensor means for determining the air flow $\Phi_{tot}$ of the air which, in use, is supplied to the incinerator, the computer being arranged to determine on the basis of the measured fractions $X_{CO2}$, $X_{O2}$ and $X_{H2O}$, the ash-free heating value ($H_{waste,ash\text{-}free}$, [J/kg ash-free]) and/or, further on the basis of the measured air flow $\Phi_{tot}$, the amount of heat ($Q_{heat}$, [W]) which is released upon the combustion.

7. A system according to claim 6, characterized in that, in use, the computer determines the amount of $Q_{heat}$ which is released upon the combustion, on the basis of the formulae:

$$Q_{heat} = H_{waste,ashfree}\cdot\frac{\Phi_{CHyOz}\cdot M_{CHyOz}}{1 - X_{H2O,ashfree}}; \text{ and} \quad (19)$$

$$\Phi_{CHyOz} = \frac{X_{CO2}\cdot X_{N2,air}}{X_C\cdot X_{N2}}(\Phi_{primary} + \Phi_{secondary}) \quad (9)$$

8. A system according to claim 6, characterized in that the computer is further arranged for determining, on the basis of the predetermined value of the inert fraction of the waste ($X_{inert}$, [kg inert/kg waste]), the following parameters: the waste flow ($\Phi_{waste}$, [kg/s]), the moisture fraction of the waste ($X_{H2O,waste}$, [kg water/kg waste]), the heating value of the total waste ($H_{waste}$, [J/kg waste]) and/or the fraction of uncombusted ($X_{uncombusted,\ [kg\ C/kg\ ash]}$).

9. A system according to claim 8, characterized in that, in use, the computer determines $\Phi_{waste}$ on the basis of the following formula:

$$\Phi_{waste} = \frac{\Phi_{CHyOz}\cdot M_{CHyOz} + \Phi_{H2O}\cdot M_{H2O}}{1 - X_{inert}} \quad (20)$$

10. A system according to claim 9, characterized in that, in use, the computer calculates $X_{H2O,waste}$ on the basis of the following formula:

$$X_{H2O} = \frac{\Phi_{H2O}\cdot M_{H2O}}{\Phi_{waste}} \quad (21)$$

11. A system according to claim 10, characterized in that, in use, the computer calculates $H_{waste}$ on the basis of the following formula:

$$H_{waste}=(1-X_{inert}-X_{H2O}).H_{CHyOz}-X_{H2O}.H_{evap} \quad (22)$$

12. A system according to claim 10, characterized in that, in use, the computer determines $X_{uncombusted}$ on the basis of the following formula:

$$X_{uncombusted} = \frac{(1 - X_c)\cdot 0.012}{\frac{M_{CHyOz}\cdot X_{inert}}{1 - X_{inert} - X_{H2O,waste}} + (1 - X_c)\cdot 0.012} \quad (23)$$

* * * * *

UNITED STATES PATENT AND TRADEMARK OFFICE

CERTIFICATE OF CORRECTION

PATENT NO. : 6,675,726 B1
DATED : January 13, 2004
INVENTOR(S) : van Kessel et al.

It is certified that error appears in the above-identified patent and that said Letters Patent is hereby corrected as shown below:

Column 1,
Lines 19-25, delete the following: "This invention relates to a system for determining process parameters relating to thermal combustion processes of matter such as, for instance, waste in an incinerator, comprising sensor means and a computer coupled thereto for determining the parameters, wherein, in use, matter having a combustible part $CH_yO_z$ is supplied to the incinerator and combusted, thereby forming a flue gas."
Lines 52-62, delete the following "The object of the invention is to provide a system that can be utilized in a plant for combustion of matter to meet the drawbacks outlined. Accordingly, the system for determining process parameters relating to the thermal combustion of matter is characterized in that the sensor means are arranged for measuring the fractions $X_{CO2}$, $X_{O2}$ and $XH_{20}$ in the flue gas and that the computer is arranged for determining, on the basis of the measured fractions, the composition (y/z) and/or the heat of combustion ($H_{CHyOz,}$, [J/kg]) of the combustible part $CH_yO_{z,}$ with $X_{02}$, $X_{H2O}$, $X_{CO2}$ respectively representing the fractions of $O_2$, $H_2O$ and $CO_2$ in the flue gas."

Column 2,
Line 60, now reads "is designed by" should read -- is designated by --

Signed and Sealed this

Twenty-fifth Day of May, 2004

JON W. DUDAS
*Acting Director of the United States Patent and Trademark Office*